US011300046B2

(12) United States Patent
Tanno et al.

(10) Patent No.: US 11,300,046 B2
(45) Date of Patent: Apr. 12, 2022

(54) COMPRESSION-IGNITION INTERNAL COMBUSTION ENGINE

(71) Applicants: TOYOTA JIDOSHA KABUSHIKI KAISHA, Toyota (JP); KABUSHIKI KAISHA TOYOTA JIDOSHOKKI, Kariya (JP)

(72) Inventors: Shiro Tanno, Gotemba (JP); Tsutomu Kawae, Kariya (JP)

(73) Assignees: TOYOTA JIDOSHA KABUSHIKI KAISHA, Toyota (JP); KABUSHIKI KAISHA TOYOTA JIDOSHOKKI, Kariya (JP)

( * ) Notice: Subject to any disclaimer, the term of this patent is extended or adjusted under 35 U.S.C. 154(b) by 61 days.

(21) Appl. No.: 16/430,602

(22) Filed: Jun. 4, 2019

(65) Prior Publication Data

US 2020/0011236 A1 Jan. 9, 2020

(30) Foreign Application Priority Data

Jul. 9, 2018 (JP) ..... JP2018-129991

(51) Int. Cl.
*F02B 77/02* (2006.01)
*F02D 41/30* (2006.01)
(Continued)

(52) U.S. Cl.
CPC ..... *F02B 77/02* (2013.01); *F02D 41/3035* (2013.01); *F02M 55/00* (2013.01);
(Continued)

(58) Field of Classification Search
CPC . F02B 77/02; F02D 41/3035; F02M 61/1806; F02M 61/1813; F02M 61/14; F02M 55/00; F05C 2251/04
See application file for complete search history.

(56) References Cited

U.S. PATENT DOCUMENTS 9,587,606 B2 * 3/2017 Anders ..... F02M 61/1833
10,012,196 B1 7/2018 Qi et al.
(Continued)

FOREIGN PATENT DOCUMENTS

EP 1639242 B1 4/2008
EP 2175116 A1 4/2010
(Continued)

OTHER PUBLICATIONS

Nov. 27, 2019 Search Report issued in European Patent Application No. 19179257.1.

*Primary Examiner* — Syed O Hasan
(74) *Attorney, Agent, or Firm* — Oliff PLC

(57) ABSTRACT

A compression-ignition internal combustion engine includes a fuel injection nozzle including a tip end portion exposed in a combustion chamber and a nozzle hole formed at the tip end portion; and a passage forming member forming a flow guide passage through which fuel injected from the nozzle hole passes. The passage forming member includes a passage wall portion located radially outward of the flow guide passage. The passage wall portion includes a first layer that is a base portion connected to a cylinder head, and a second layer located radially outward or radially inward of the first layer. The toughness of the first layer is higher than the toughness of the second layer. The thermal conductivity of the second layer is lower than the thermal conductivity of the first layer.

7 Claims, 9 Drawing Sheets

(51) Int. Cl.
*F02M 61/18* (2006.01)
*F02M 61/14* (2006.01)
*F02M 55/00* (2006.01)

(52) U.S. Cl.
CPC ..... *F02M 61/14* (2013.01); *F02M 61/1806* (2013.01); *F05C 2251/04* (2013.01)

(56) References Cited

U.S. PATENT DOCUMENTS

| | | | | |
|---|---|---|---|---|
| 10,711,752 | B2 * | 7/2020 | Martin | F02B 23/00 |
| 10,801,395 | B1 * | 10/2020 | Mueller | F02B 23/0654 |
| 2004/0028941 | A1 * | 2/2004 | Lane | C04B 41/87 428/689 |
| 2006/0243242 | A1 | 11/2006 | Blessing et al. | |
| 2016/0097360 | A1 * | 4/2016 | Mueller | F02M 61/1813 123/294 |
| 2016/0298583 | A1 | 10/2016 | Anders et al. | |
| 2017/0152795 | A1 * | 6/2017 | Yamashita | F02B 77/11 |
| 2017/0350308 | A1 | 12/2017 | Polonowski et al. | |

FOREIGN PATENT DOCUMENTS

| | | | |
|---|---|---|---|
| EP | 3505735 | A1 | 7/2019 |
| JP | H05-005415 | A | 1/1993 |
| JP | 2004-308449 | A | 11/2004 |
| JP | 2006-307825 | A | 11/2006 |
| JP | 2012-47134 | A | 3/2012 |
| JP | 2013-092103 | A | 5/2013 |
| JP | 5629463 | B2 | 11/2014 |
| JP | 2017-155639 | A | 9/2017 |
| WO | 2018/050790 | A1 | 3/2018 |
| WO | 2018/101991 | A1 | 6/2018 |

* cited by examiner

<Sixth Embodiment>

COMPRESSION-IGNITION INTERNAL COMBUSTION ENGINE

CROSS-REFERENCE TO RELATED APPLICATION

This application is based on and claims the benefit of Japanese Patent Application No. 2018-129991, filed on Jul. 9, 2018, which is incorporated by reference herein in its entirety.

BACKGROUND

Technical Field

The present disclosure relates to a compression-ignition internal combustion engine.

Background Art

For example, US 2016/0097360 A1 discloses a technique for controlling a compression-ignition internal combustion engine to promote premixing of fuel and charged air in a combustion chamber of the engine.

According to the technique described above, a duct configured by a hollow pipe is arranged in the vicinity of an opening (i.e., nozzle hole) of a tip end portion of a fuel injection device that is exposed in the combustion chamber. The fuel that is injected from the opening passes through this duct and is injected into the combustion chamber from the duct.

SUMMARY

The duct of the compression-ignition internal combustion engine disclosed in US 2016/0097360 A1 is exposed in the combustion chamber. Because of this, there is a concern that, as a result of the duct being exposed to a high-temperature combustion gas, the temperature of the duct may become higher. In addition, it is assumed that various kinds of weights or loads may be repeatedly applied to the duct due to an effect (such as, an effect of a vibration produced by the internal combustion engine itself, an effect of an in-cylinder pressure that goes up and down during a cycle, or an effect of fuel injection pressure).

The present disclosure has been made to address the problem described above, and an object of the present disclosure is to provide a compression-ignition internal combustion engine that includes a passage wall portion of a flow guide passage through which a fuel that is injected from a nozzle hole of a fuel injection nozzle or an in-cylinder gas passes, and that can enhance the reliability of shape retention of the passage wall portion and also reduce an increase of a wall surface temperature of the flow guide passage.

A compression-ignition internal combustion engine according to one aspect of the present disclosure includes: a fuel injection nozzle including a tip end portion exposed in a combustion chamber and a nozzle hole formed at the tip end portion; and a passage forming member forming a flow guide passage through which fuel injected from the nozzle hole passes. The passage forming member includes a passage wall portion located radially outward of the flow guide passage. The passage wall portion includes a first layer that is a base portion connected to a cylinder head, and a second layer located radially outward or radially inward of the first layer. A toughness of the first layer is higher than a toughness of the second layer. A thermal conductivity of the second layer is lower than a thermal conductivity of the first layer.

The second layer may be located radially outward of the first layer.

A gap may be formed between an outlet of the nozzle hole and an inlet of the flow guide passage. A heat capacity per unit volume of the second layer may also be smaller than a heat capacity per unit volume of the first layer.

One or more communication holes that cause the flow guide passage to communicate with the combustion chamber may be formed in the passage wall portion. A heat capacity per unit volume of the second layer may be smaller than a heat capacity per unit volume of the first layer.

The passage forming member may further include a support portion interposed between the first layer and the cylinder head. The passage wall portion may also be composed of the first layer and the second layer and be formed into a cylindrical shape.

The passage forming member may be integrally formed with the cylinder head.

The passage forming member may be fastened to a combustion chamber ceiling of the cylinder head.

A compression-ignition internal combustion engine according to another aspect of the present disclosure includes: a fuel injection nozzle including a tip end portion exposed in a combustion chamber at a central part of a combustion chamber ceiling and a nozzle hole formed at the tip end portion; and a piston arranged in a cylinder and including a top portion where a flow guide passage through which gas in the cylinder passes is formed. The flow guide passage extends from an inlet exposed in the combustion chamber on a side of a wall of a bore of the cylinder toward an outlet exposed in the combustion chamber on a side of a center of the bore. The piston includes a passage wall portion located on a side of the combustion chamber ceiling with respect to the flow guide passage. The passage wall portion includes a first layer that is a base portion connected to the piston, and a second layer located on a side of the piston or a side of the combustion chamber ceiling with respect to the first layer. A toughness of the first layer is higher than a toughness of the second layer. A thermal conductivity of the second layer is lower than a thermal conductivity of the first layer.

A heat capacity per unit volume of the second layer may be smaller than a heat capacity per unit volume of the first layer.

According to the compression-ignition internal combustion engine in one aspect of the present disclosure, the passage wall portion of the flow guide passage through which the fuel that is injected from the nozzle hole passes includes the first layer and the second layer located radially outward or radially inward of the first layer. Also, the first layer is connected to the cylinder head, and the toughness of the first layer is higher than the toughness of the second layer. As a result, even if the weight or load described above is repeatedly applied to the passage wall portion, the shape of the passage wall portion can be easy to be maintained over a long time. In addition, the thermal conductivity of the second layer is lower than the thermal conductivity of the first layer. As a result, the heat transferred to the outer wall of the passage wall portion from a high-temperature combustion gas around the passage wall portion can be prevented from being transferred to the inner wall of the passage wall portion (i.e., the wall surface of the flow guide passage). As just described, according to one aspect of the present disclosure, the reliability of the shape retention of the passage wall portion can be favorably enhanced, and an increase of the wall surface temperature of the flow guide passage can be favorably reduced.

Furthermore, according to the compression-ignition internal combustion engine in another aspect of the present disclosure, the flow guide passage is formed, on the top portion of the piston, so as to extend from the inlet exposed in the combustion chamber on the side of the wall of the bore of the cylinder toward the outlet exposed in the combustion chamber on the side of the center of the bore. The piston includes the passage wall portion located on the side of the combustion chamber ceiling with respect to this flow guide passage. The passage wall portion includes the first layer and the second layer located on the side of the piston or the side of the combustion chamber ceiling with respect to this first layer. Also, the first layer is connected to the piston, and the toughness of the first layer is higher than the toughness of the second layer. As a result, even if the weight or load described above is repeatedly applied to the passage wall portion, the shape of the passage wall portion can be easy to be maintained over a long time. In addition, the thermal conductivity of the second layer is lower than the thermal conductivity of the first layer. As a result, the heat transferred to the wall of the passage wall portion on the combustion chamber ceiling side from a high-temperature combustion gas around the passage wall portion can be prevented from being transferred to the wall of the passage wall portion on the piston side (i.e., the wall surface of the flow guide passage). As just described, according to another aspect of the present disclosure, similarly to one aspect described above, the reliability of the shape retention of the passage wall portion can be favorably enhanced, and an increase of the wall surface temperature of the flow guide passage can be favorably reduced.

DETAILED DESCRIPTION

Figure 1:
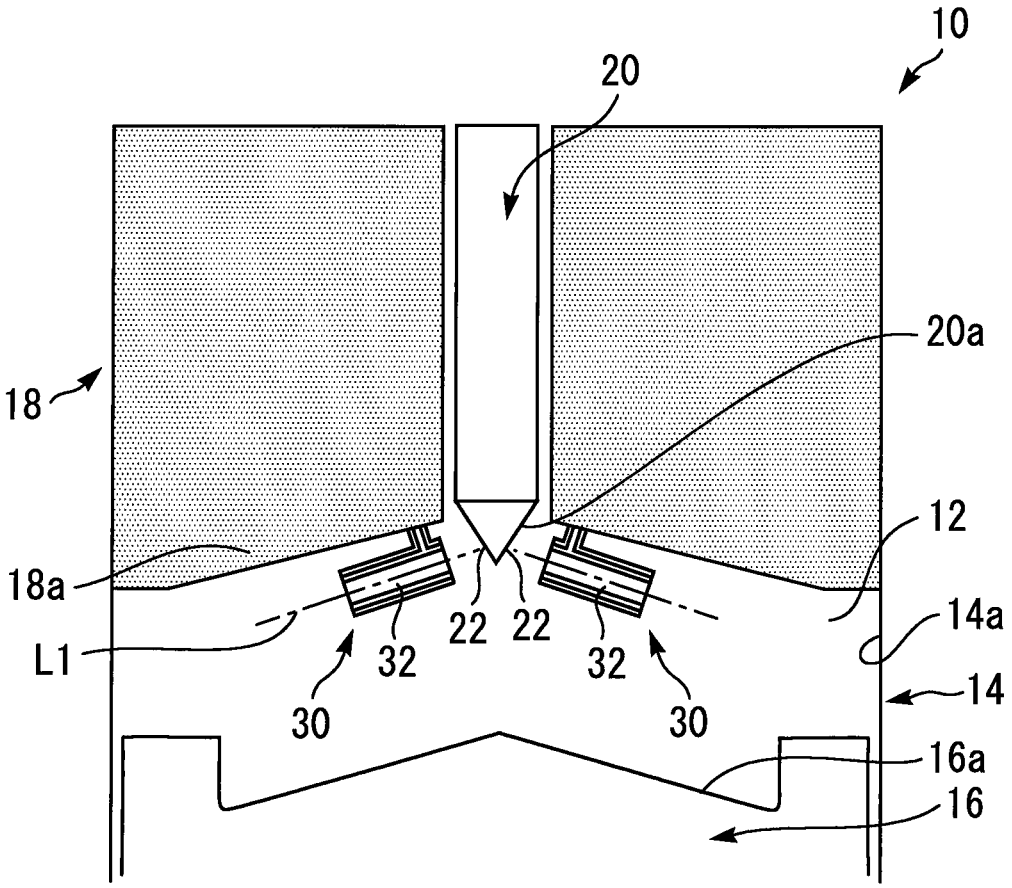
FIG. 1 is a longitudinal sectional view that schematically illustrates the configuration in and around a combustion chamber of a compression-ignition internal combustion engine according to a first embodiment of the present disclosure.

In the following embodiments of the present disclosure, the same components in the drawings are denoted by the same reference numerals, and redundant descriptions thereof are omitted or simplified. Moreover, it is to be understood that even when the number, quantity, amount, range or other numerical attribute of an element is mentioned in the following description of the embodiments, the present disclosure is not limited to the mentioned numerical attribute unless explicitly described otherwise, or unless the present disclosure is explicitly specified by the numerical attribute theoretically. Furthermore, structures or steps or the like that are described in conjunction with the following embodiments are not necessarily essential to the present disclosure unless explicitly shown otherwise, or unless the present disclosure is explicitly specified by the structures, steps or the like theoretically.

1. First Embodiment

A first embodiment according to the present disclosure and modification examples thereof will be described with reference to FIGS. 1 to 5.

1-1. Configuration In and Around Combustion Chamber

FIG. 1 is a longitudinal sectional view that schematically illustrates the configuration in and around a combustion chamber 12 of a compression-ignition internal combustion engine (hereunder, simply abbreviated as an "internal combustion engine") 10 according to the first embodiment of the present disclosure. As an example, the internal combustion engine 10 shown in FIG. 1 is a diesel engine.

As shown in FIG. 1, the internal combustion engine 10 is provided with a cylinder block 14, pistons 16 and a cylinder head 18. The pistons 16 reciprocate inside the respective cylinders formed in the cylinder block 14. The cylinder head 18 is arranged on the cylinder block 14. The combustion chamber 12 is mainly defined by a cylinder bore surface 14*a* of the cylinder block 14, a top surface 16*a* of the piston 16, a surface of a combustion chamber ceiling 18*a* of the cylinder head 18, and bottom surfaces of intake and exhaust valves (not shown).

The internal combustion engine 10 is further provided with a fuel injection nozzle 20 and ducts 30. The fuel injection nozzle 20 is arranged at the center of the combustion chamber ceiling 18*a*. The fuel injection nozzle 20 has a tip end portion 20*a* that is exposed in the combustion chamber 12. A plurality of (for example, eight) nozzle holes 22 are formed at the tip end portion 20*a*. These eight nozzle holes 22 are formed such that fuel is injected in a radial manner toward the cylinder bore surface 14*a*.

The ducts 30 are respectively provided with respect to eight nozzle holes 22. Because of this, the number of ducts in the example shown in FIG. 1 is eight. Each of the ducts 30 is formed into a cylindrical shape. A flow guide passage 32 is formed in the interior of each of the ducts 30. The fuel injected from each of the nozzle holes 22 is injected in the combustion chamber 12 after passing through the corresponding flow guide passage 32. It should be noted that the number of "flow guide passages" according to one aspect of the present disclosure may not always be the same as that of nozzle holes, and may be provided only for a part of a plurality of nozzle holes. Hereunder, the concrete structure in and around the ducts 30 will be described in detail with reference to FIGS. 2 and 3.

1-1-1. Example of Concrete Shape In and Around Duct

Figure 2:
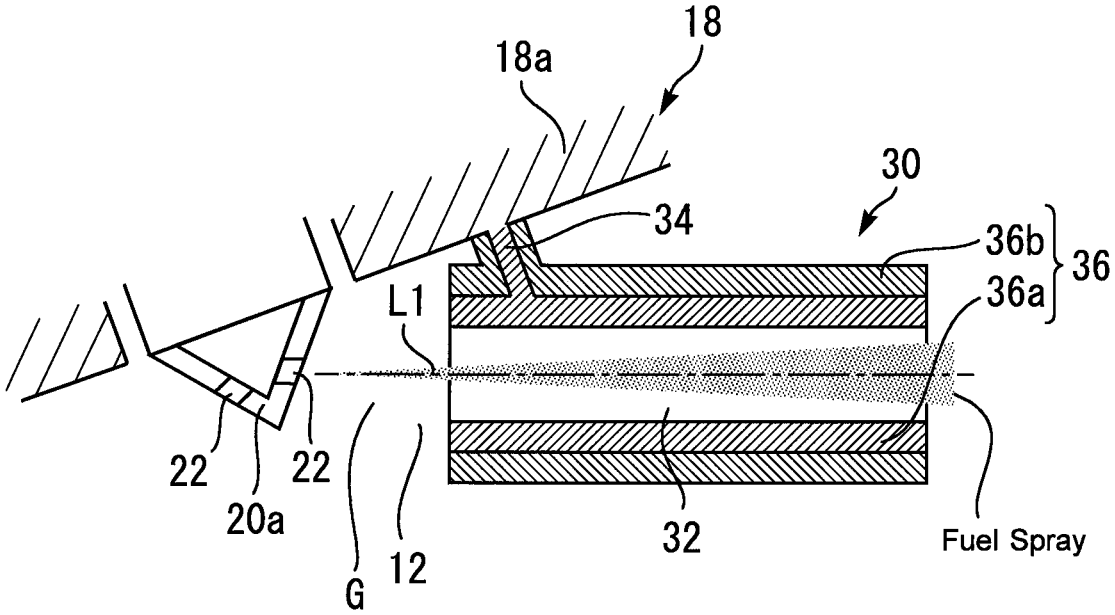
FIG. 2 is an enlarged longitudinal sectional view that schematically illustrates one duct in FIG. 1 and around this duct.
Figure 3:
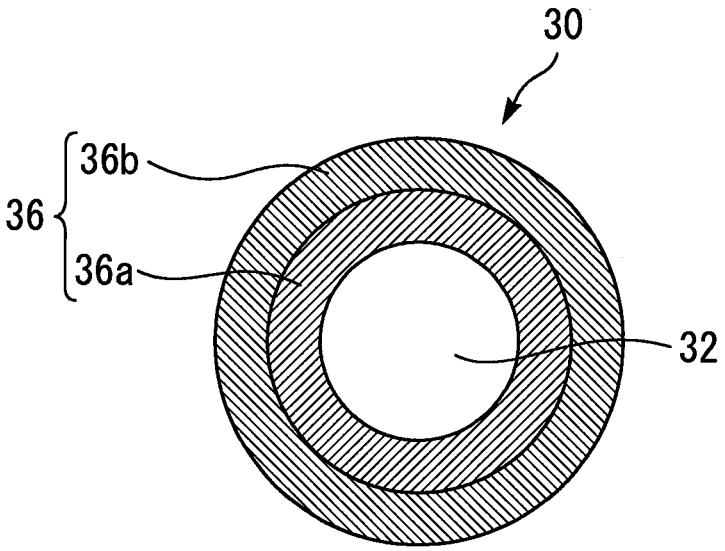
FIG. 3 is a transverse sectional view of the duct in FIG. 1.

FIG. 2 is an enlarged longitudinal sectional view that schematically illustrates one duct 30 in FIG. 1 and around this duct 30. FIG. 3 is a transverse sectional view of the duct 30 shown in FIG. 1. According to the example shown in FIG. 2, the duct 30 is fixed to (i.e., suspended from) the combustion chamber ceiling 18*a* of the cylinder head 18 with a support portion 34 interposed therebetween. The duct 30 is arranged such that the central axis line of the flow guide passage 32 is aligned with an axis line L1 of the nozzle hole 22. In other words, the duct 30 is formed so as to extend straight along the axis line L1 of the nozzle hole 22. In addition, as shown in FIG. 3, the flow passage cross-section of the duct 30 is a circle as an example, and thus, the duct 30 (more specifically, a passage wall portion 36 described below) is formed into a cylindrical shape.

According to the present embodiment, the duct 30 suspended from the combustion chamber ceiling 18*a* with the support portion 34 interposed therebetween corresponds an example of the "passage forming member" that forms the flow guide passage 32. The duct 30 includes the passage wall portion 36 located radially outward of the flow guide passage 32, and the support portion 34 described above. The passage wall portion 36 has a double-layered structure composed of a first layer 36*a* and a second layer 36*b*.

The first layer 36*a* corresponds to a base portion (base layer) connected to the combustion chamber ceiling 18*a* of the cylinder head 18 with the support portion 34 interposed therebetween. That is to say, the first layer 36*a* of the duct 30 is supported by the support portion 34. According to the example shown in FIG. 2, although the first layer 36*a* and the support portion 34 are integrally formed with the combustion chamber ceiling 18*a*, any two or all of them may alternatively be separated from each other. In other words, the first layer 36*a* has only to be integrally or separately connected to the cylinder head 18.

The second layer 36*b* is located radially outward (i.e., on the outer peripheral side) of the first layer 36*a*. Also, according to the example shown in FIG. 2, the second layer 36*b* is formed so as to cover not only the first layer 36*a* but also the support portion 34. In addition, according to the example shown in FIG. 2, the first layer 36*a* and the second layer 36*b* are both formed into a cylindrical shape. Moreover, the first layer 36*a* is formed so as to extend over the whole passage wall portion 36 in the longitudinal direction of the flow guide passage 32 and to cover the whole first layer 36*a*. Furthermore, the second layer 36*b* covers the whole first layer 36*a* also in the circumferential direction thereof.

Moreover, according to the example shown in FIG. 2, the outer surface of the tip end portion 20*a* having the nozzle hole 22 is not in contact with the duct 30. In other words, a gap G is formed between the outlet of the nozzle hole 22 and the inlet of the flow guide passage 32. In addition, not only the outlet of the duct 30 (flow guide passage 32) but also the inlet thereof is exposed in the combustion chamber 12. Gas (i.e., working gas) in the combustion chamber 12 uses this gap G to flow into the flow guide passage 32 as well as the fuel injected from the nozzle hole 22.

1-1-2. Specific Example of Material of Duct Having Double-Layered Structure

The first layer 36*a* and the second layer 36*b* of the duct 30 meet the following relationships with respect to the toughness and thermal conductivity of materials thereof. That is to say, the toughness of the first layer 36*a* that is the base layer of the duct 30 is higher than the toughness of the second layer 36*b* that is the outer layer thereof. Also, the thermal conductivity of the second layer 36*b* is lower than the thermal conductivity of the first layer 36*a*. An example of the material of the first layer 36*a* that meets these relationships is a metal (such as, aluminum or iron), and an example of the material of the second layer 36*b* is a silicon nitride ($Si_3N_4$). It should be noted that the "toughness" mentioned here means the properties of tenacity with respect to the fracture of a material, and one of specific indexes thereof is fracture toughness.

To be more specific, the second layer 36*b* can be obtained as a result of a coating of the silicon nitride being formed on the first layer 36*a* using, for example, thermal spraying. Since the thermal conductivity of the second layer 36*b* is lower than the thermal conductivity of the first layer 36*a* as described above, the second layer 36*b* functions as a heat-shielding film.

1-2. Advantageous Effects

1-2-1. Advantageous Effects by Use of Duct (Flow Guide Passage)

According to the compression-ignition internal combustion engine 10, fuel is injected from the fuel injection nozzle 20 when air charged into the combustion chamber 12 is in a compressed state. It is favorable that, after the injected fuel is mixed with the charged air and homogenization of the fuel concentration is promoted, compression-ignition combustion is performed. However, in an example without including the duct 30, there is a concern that fuel injected from the fuel injection nozzle 20 may receive heat of the combustion chamber 12 to quickly overheat, and, as a result, a self-ignition of the fuel may be performed before the fuel is sufficiently mixed with the charged air. As a result, smoke may be produced due to excessively rich fuel burning, or the thermal efficiency may be decreased due to prolongation of an afterburning time.

According to the internal combustion engine 10 of the first embodiment, in order to address the issue described above, the duct(s) 30 is arranged in the combustion chamber 12. According to this kind of configuration, the spray of fuel injected from the nozzle hole 22 of the fuel injection nozzle 20 is introduced into the interior of the duct 30 (i.e., into the flow guide passage 32). In addition, since the inlet of the duct 30 is exposed in the combustion chamber 12, the charged air in the combustion chamber 12 is also guided to the interior of the duct 30 from the inlet thereof. As a result, in the interior of the duct 30 whose temperature is basically lower than that in the vicinity thereof, the spray of the fuel and the charged air are mixed while being cooled, and thus, homogenization of the fuel concentration is promoted without the fuel spray being self-ignited early. Moreover, after the air-fuel mixture is sufficiently premixed, it is injected from the outlet of the duct 30. The injected air-fuel mixture receives heat from the combustion chamber 12 to be self-ignited and burn.

As described above, with the installation of the duct(s) 30 (flow guide passage(s) 32), in the course of the spray of the fuel which is injected passing through the duct 30, premix of the fuel spray and the charged air can be promoted while the occurrence of self-ignition is reduced. As a result, it becomes possible to reduce the occurrence of smoke due to the fact that the excessively rich fuel before homogenized is self-ignited. In addition, with the installation of the duct(s) 30, since the occurrence of self-ignition is reduced during the fuel passing through the duct 30, the timing of self-ignition can be retarded. Because of this, the afterburning time is shortened, and the thermal efficiency can thus be improved.

1-2-2. Issue Concerning Installation of Duct (Flow Guide Passage)

A duct as in the duct 30 is exposed in a combustion chamber. That is to say, this kind of duct is arranged at a location in which the temperature thereof is easy to become higher due to the fact that the duct is exposed to a high-temperature combustion gas. If the temperature of the wall surface of a flow guide passage (i.e., the inner wall of the duct) becomes high due to the heat received from combustion gas, the fuel spray passing through the duct is heated due to the heat received from the wall surface of the flow guide passage. As a result, the ignition delay is shortened (i.e., the above-described effect of retarding the self-ignition timing decreases), and thus, the combustion is started when the mixing of the fuel spray and the charged air is insufficient. Because of this, there is a concern that it may become difficult to properly reduce the occurrence of smoke.

Furthermore, it is assumed that various kinds of weights or loads may be repeatedly applied to the duct due to an effect (such as, an effect of a vibration produced by the internal combustion engine itself, an effect of an in-cylinder pressure that goes up and down during a cycle, or an effect of fuel injection pressure). Thus, it is required for countermeasures regarding reduction of temperature increase of the wall surface of a flow guide passage (i.e., the inner wall of a duct) to be made such that, even if a weight or load is repeatedly applied to the duct, the shape of the duct can be more surely maintained over a long time.

1-2-3. Adoption of Duct Having Double-Layered Structure

In view of the issue described above, according to the passage wall portion 36 of the duct 30 of the present embodiment, the first layer 36*a* is configured as a base portion of the duct 30 that is connected to the cylinder head 18 (combustion chamber ceiling 18*a*) with the support portion 34 interposed therebetween. Moreover, the materials of this first layer 36*a* and the second layer 36*b* are selected such that the toughness of the first layer 36*a* becomes higher than the toughness of the second layer 36*b*. As a result, even if the weight or load described above is repeatedly applied to the duct 30, the shape of the duct 30 (passage wall portion 36) can be easy to be maintained over a long time.

Furthermore, the materials of the first layer 36*a* and the second layer 36*b* are selected such that the thermal conductivity of the second layer 36*b* located on the outer peripheral side of the first layer 36*a* becomes lower than the thermal conductivity of the first layer 36*a*. As a result, the heat transferred to the outer wall of the passage wall portion 36 (i.e., the outer wall of the second layer 36*b*) from a high temperature combustion gas around the duct 30 can be prevented from being transferred to the inner wall of the passage wall portion 36 (i.e., the wall surface of the flow guide passage 32). Because of this, when the fuel passes through the flow guide passage 32 located on the inner side of the passage wall portion 36, an increase of the temperature of the fuel can be reduced. As a result, a decrease of the effect of retarding the self-ignition timing can be reduced.

As described so far, according to the internal combustion engine 10 of the present embodiment, the reliability of shape retention of the duct 30 (passage wall portion 36) can be favorably enhanced, and also an increase of the wall surface temperature of the flow guide passage 32 can be favorably reduced.

Furthermore, according to the duct 30 of the present embodiment, the support portion 34 is also covered by the second layer 36*b*. Because of this, the transfer of heat to the first layer 36*a* (i.e., the portion that serves as the inner wall of the flow guide passage 32) from a high-temperature combustion gas with the support portion 34 interposed therebetween can also be effectively reduced.

1-3. Modification Examples Concerning First Embodiment

1-3-1. Another Example of Double-Layered Structure for Duct

Figure 4:
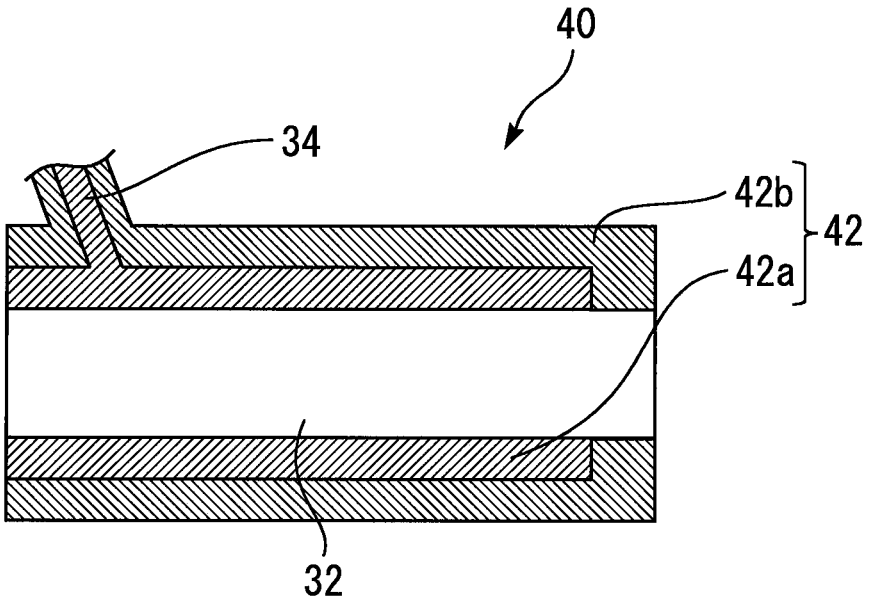
FIG. 4 is a schematic diagram for describing another example of the configuration of first and second layers of a passage wall portion.

FIG. 4 is a schematic diagram for describing another example of the configuration of the first and second layers of the passage wall portion. It should be noted that FIG. 4 shows only one of ducts 40, and this also applies to FIGS. 5 to 7. According to the example shown in FIG. 4, a duct 40 (i.e., passage forming member) includes a passage wall portion 42 along with the support portion 34. The passage wall portion 42 includes a first layer 42*a* and a second layer 42*b* located radially outward of the first layer 42*a*.

According to the example of the duct 30 shown in FIG. 2, the first layer 36*a* is formed so as to extend over the whole passage wall portion 36 in the longitudinal direction of the flow guide passage 32, and the second layer 36*b* is formed so as to cover the whole first layer 36*a*. In contrast to this, according to the example of the duct 40 shown in FIG. 4, the first layer 42*a* does not extend over the whole passage wall portion 42 in the longitudinal direction of the flow guide passage 32, and, at an end portion of the flow guide passage 32 on its outlet side, the inner wall of the flow guide passage 32 is configured by the second layer 42*b*.

As shown by the example described above, the "first layer" according to one aspect of the present disclosure may not always extend over the whole passage wall portion in the longitudinal direction of the flow guide passage, and this also applies to the "second layer". In other words, the double-layered structure may be provided not for the whole duct (passage wall portion) but for only a part of the duct, provided that, in order to enhance the reliability of shape retention of the first layer, the connection between the first layer and the cylinder head is not broken by the second layer. In addition, this also applies to other second to sixth embodiments described below.

1-3-2. Still Another Example of Double-Layered Structure for Duct

Figure 5:
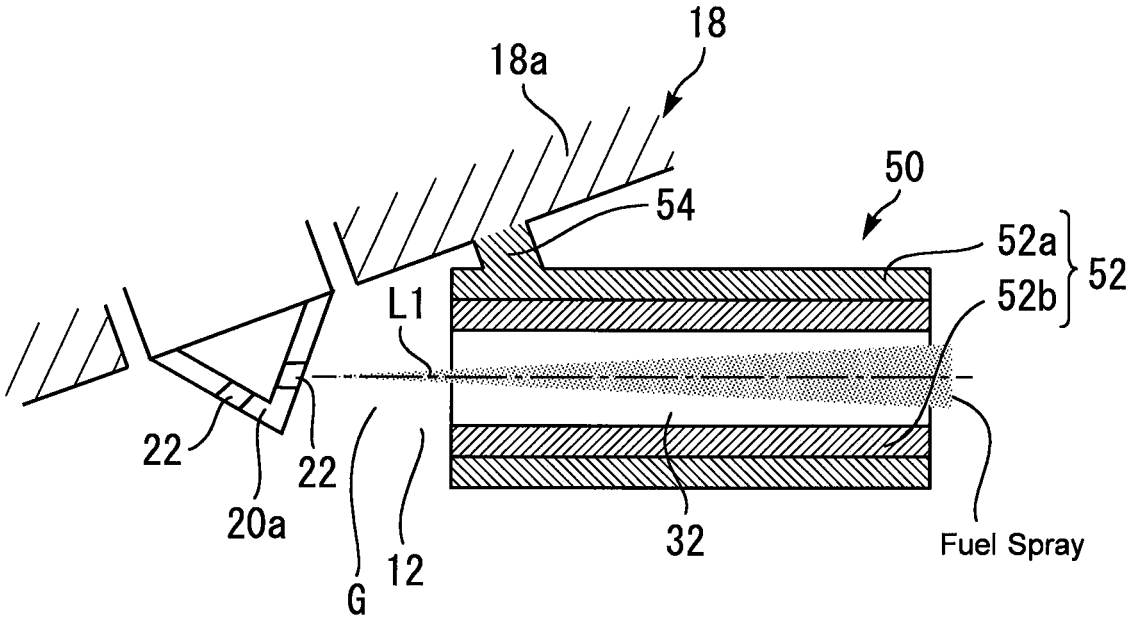
FIG. 5 is a schematic diagram for describing still another example of the configuration of the first and second layers of the passage wall portion.

FIG. 5 is a schematic diagram for describing still another example of the configuration of the first and second layers of the passage wall portion. According to the example shown in FIG. 5, a duct 50 (i.e., passage forming member) includes a passage wall portion 52 along with a support portion 54. The passage wall portion 52 includes a first layer 52*a* and a second layer 52*b* located radially inward of the first layer 52*a*, contrary to the example of the duct 30 shown in FIG. 2.

According to the configuration in which the second layer 52*b* corresponding to the heat-shielding film as described above is arranged on the inner side of the first layer 52*a* (i.e., base layer), heat that is transferred to the outer wall of the passage wall portion 52 (i.e., the outer wall of the first layer 52*a*) from a high-temperature combustion gas around the duct 50 can also be prevented from being transferred to the inner wall of the passage wall portion 52 (i.e., the wall surface of the flow guide passage 32). When the ease of production of the passage wall portion is also taken into consideration, the configuration in which the second layer 36*b* is located radially outward as in the duct 30 shown in FIG. 2 is superior. However, in terms of achieving the advantageous effects of reducing an increase of the wall surface temperature of the flow guide passage 32, the configuration as shown in FIG. 5 may alternatively be used.

2. Second Embodiment

Then, a second embodiment according to the present disclosure will be described with reference to FIG. 6.

2-1. Difference from First Embodiment

Figure 6:
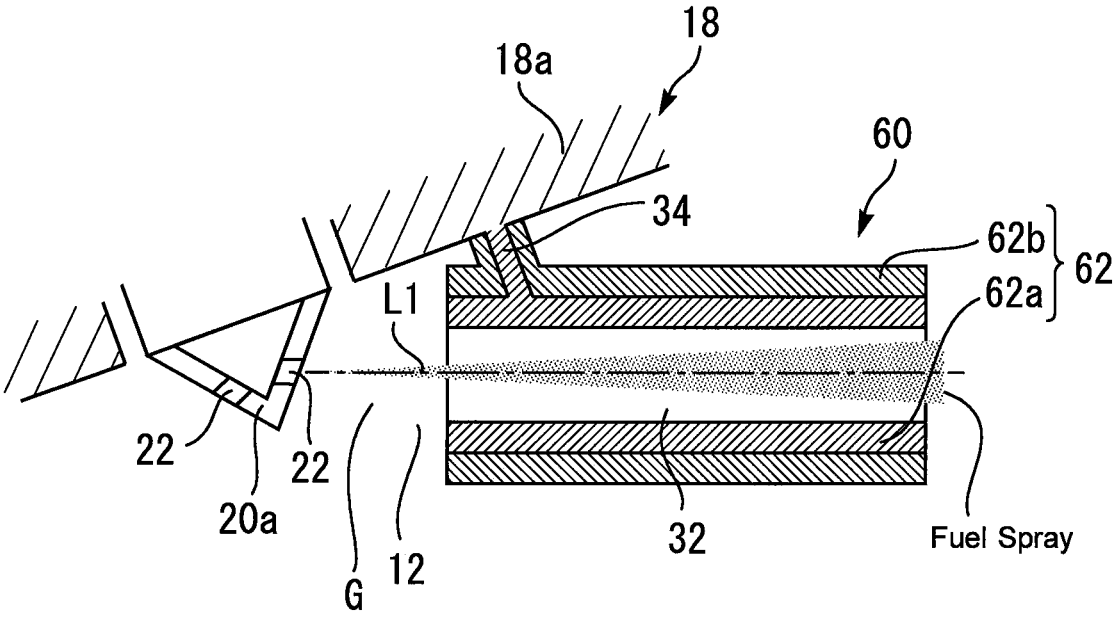
FIG. 6 is a schematic diagram for describing the configuration of a duct according to a second embodiment of the present disclosure.

FIG. 6 is a schematic diagram for describing the configuration of a duct 60 according to the second embodiment of the present disclosure. An internal combustion engine according to the present embodiment is different, in the following points, from the internal combustion engine 10 according to the first embodiment.

The duct 60 shown in FIG. 6 includes a passage wall portion 62 along with the support portion 34. The passage wall portion 62 includes a first layer 62*a* and a second layer 62*b*. The shape and material of the first layer 62*a* is the same as those of the first layer 36*a* shown in FIG. 2. On the other hand, the second layer 62*b* has the same shape as the second layer 36*b* shown in FIG. 2 but the second layer 62*b* and the second layer 36*b* are different in material as described below.

More specifically, an example of the material of the second layer 62*b* is zirconia ($ZrO_2$). The second layer 62*b* having the zirconia as a raw material can be obtained by forming a coat of zirconia on the first layer 62*a* using, for example, thermal spraying. The second layer 62*b* and the first layer 62*a* whose materials are selected in this way meet the following relationships with respect to the toughness and thermal conductivity and heat capacity per unit volume of these materials. That is to say, the relationships with respect to the toughness and thermal conductivity in the second embodiment are the same as those in the first embodiment, and thus, the toughness of the first layer 62*a* is higher than that of the second layer 62*b* and the thermal conductivity of the second layer 62*b* is lower than that of the first layer 62*a*. On that basis, the heat capacity per unit volume of the second layer 62*b* is smaller than that of the first layer 62*a*.

2-2. Advantageous Effects

According to the internal combustion engine of the present embodiment that includes the duct(s) 60 described so far, the reliability of shape retention of the duct 60 (passage wall portion) can also be favorably enhanced, and an increase of the wall surface temperature of the flow guide passage 32 can also be favorably reduced. On that basis, according to the present embodiment, an additional issue described below can also be addressed.

That is to say, in an internal combustion engine including a duct as in the duct 30 or 60, a charged air (working gas) around the duct is suctioned into the interior (flow guide passage) of the duct from a gap between a nozzle hole and the inlet of the duct (the gap G shown in FIGS. 2 and 6 corresponds to this gap). An increase of the temperature of the inner wall of the first layer 36*a* (i.e., the wall surface of the flow guide passage 32) can be reduced by the use of the duct 30 according to the first embodiment that includes the second layer 36*b* with a low thermal conductivity. If, however, the heat capacity per unit volume of the material of the second layer 36*b* is great (for example, silicon nitride), the temperature of the outer wall of the duct 30 (i.e., the outer peripheral wall of the second layer 36*b*) always becomes higher. As a result, when the duct 30 suctions a charged air around the duct 30, the charged air is heated by the outer wall. Because of this, there is a concern that the effect of reducing the self-ignition using the duct (i.e., the effect of retarding the self-ignition timing) may not be sufficiently achieved.

In view of the additional issue described above, according to the duct 60 (passage wall portion 62) of the present embodiment, the materials of the first layer 62*a* and the second layer 62*b* are selected such that the second layer 62*b* corresponding to the outer wall of the duct 60 becomes smaller in heat capacity per unit volume than the first layer 62*a*. As a result, the temperature of the second layer 62*b* becomes easy to increase and decrease in association with the in-cylinder gas temperature increasing and decreasing during one cycle. This can prevent the temperature of the second layer 62*b* from always becoming high. Thus, according to the duct 60 of the present embodiment, heating of a charged air that is suctioned into the duct 60 via the gap G (see FIG. 6) can be reduced while the advantageous effects of reduction of temperature increase of the wall surface of the flow guide passage 32 (i.e., the inner wall of the first layer 62*a*) is achieved similarly to the first embodiment. Because of this, the effect of reducing the self-ignition using the duct 60 (i.e., the effect of retarding the self-ignition timing) can be more effectively achieved as compared to that of the first embodiment.

3. Third Embodiment

Then, a third embodiment according to the present disclosure will be described with reference to FIG. 7.

3-1. Difference from Second Embodiment

Figure 7:
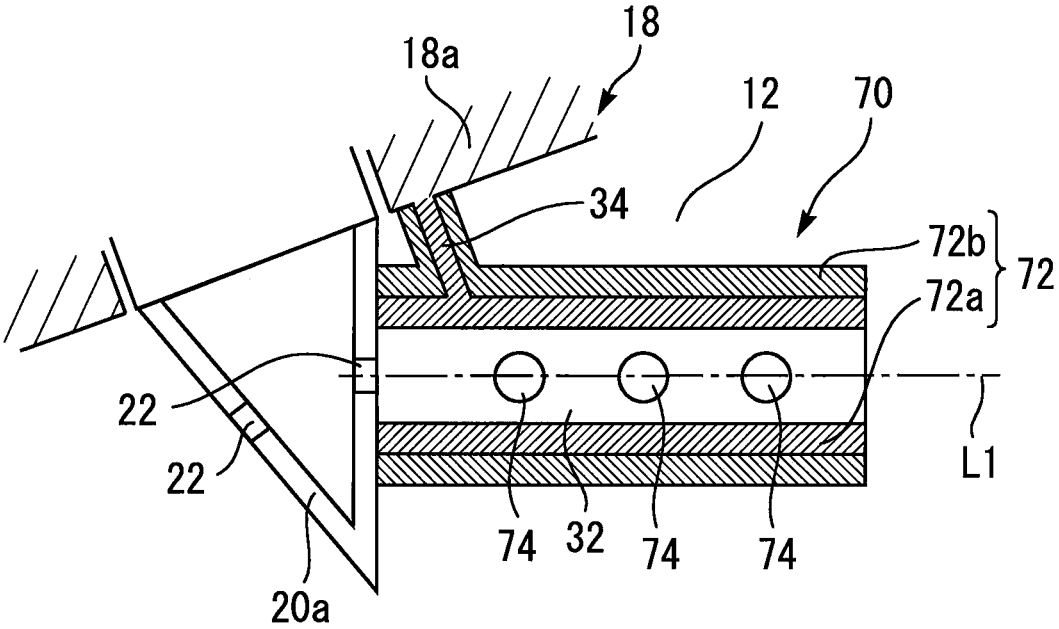
FIG. 7 is a schematic diagram for describing the configuration of a duct according to a third embodiment of the present disclosure.

FIG. 7 is a schematic diagram for describing the configuration of a duct 70 according to the third embodiment of the present disclosure. An internal combustion engine according to the present embodiment is different from the internal combustion engine according to the second embodiment in the following points.

Specifically, according to the second embodiment, the gap G is formed between the outlet of the nozzle hole 22 and the inlet of the duct 60 (i.e., the inlet of the flow guide passage 32) as shown in FIG. 6. In contrast to this, according to the present embodiment, as shown in FIG. 7, this kind of gap G is not provided, and the outer wall of the tip end portion 20*a* having the nozzle hole 22 is in contact with the inlet of the duct 70 (i.e., inlet of the flow guide passage 32). In addition, a passage wall portion 72 of the duct 70 protrudes from the outer wall of the tip end portion 20*a* along the axial line L1 of the nozzle hole 22.

The passage wall portion 72 includes a first layer 72*a* and a second layer 72*b*. The material of the first layer 72*a* is the same as that of the first layer 62*a*, and the material of the second layer 72*b* is the same as that of the second layer 62*b*. However, as shown in FIG. 7, in the passage wall portion 72, a desired number of (for example, three) communication holes 74 are formed in order to cause the flow guide passage 32 to communicate with the combustion chamber 12. The communication holes 74 penetrate through the first layer 72*a* and the second layer 72*b*. According to the duct(s) 70 including this kind of communication holes 74, the charged gas around the duct 70 flows into the flow guide passage 32 as well as the fuel injected from the corresponding the nozzle hole(s) 22, through these communication holes 74.

3-2. Advantageous Effects

As described so far, the materials of the first layer 72*a* and second layer 72*b* of the duct 70 according to the present embodiment are the same as those of the first layer 62*a* and second layer 62*b* according to the second embodiment. Because of this, according to the duct(s) 70 of the present embodiment, similar advantageous effects to those of the second embodiment can also be achieved. That is to say, the effects of reduction of temperature increase of the wall surface of the flow guide passage 32 (i.e., the inner wall of the first layer 72*a*) are achieved, and heating of the charged gas that is suctioned into the duct 70 through the communication holes 74 is reduced.

It should be noted that, although the duct(s) 70 according to the third embodiment described above uses the communication holes 74, a duct that is arranged so as to have the gap G in addition to this communication hole 74 can also achieve similar effects to those of the second and third embodiments.

4. Fourth Embodiment

Then, a fourth embodiment according to the present disclosure will be described with reference to FIGS. 8 and 9.

4-1. Difference from Second Embodiment

Figure 8:
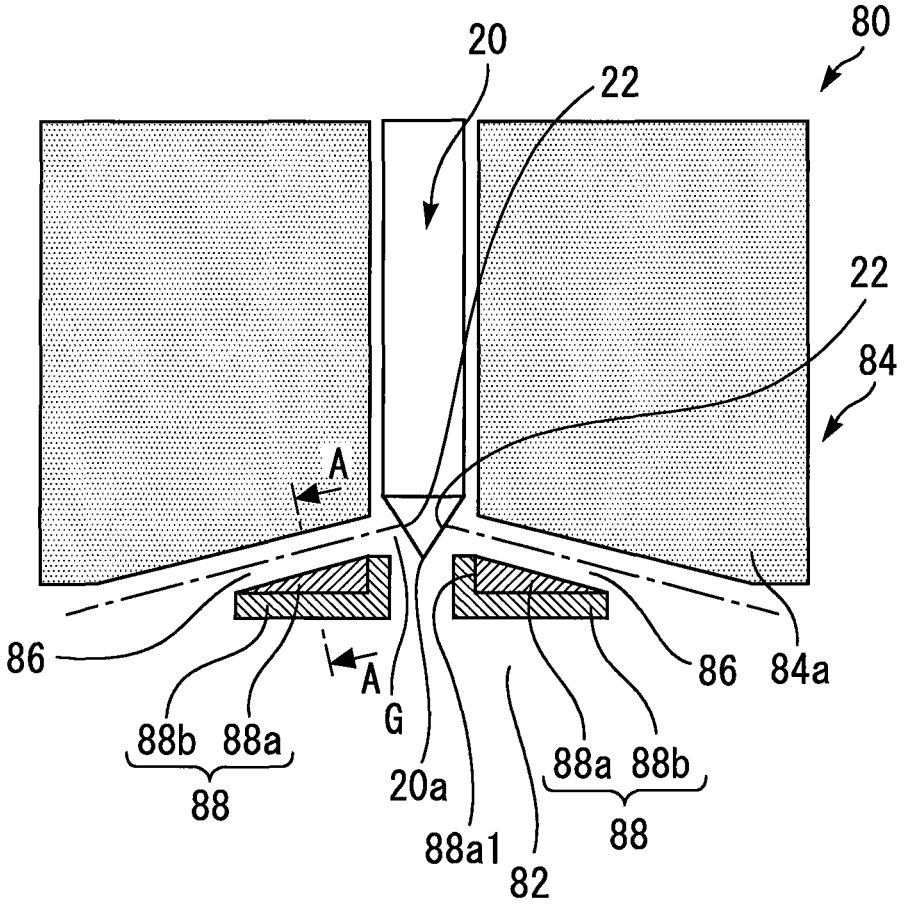
FIG. 8 is a longitudinal cross-sectional view that schematically illustrates the configuration in and around a combustion chamber of a compression-ignition internal combustion engine according to a fourth embodiment of the present disclosure.

FIG. 8 is a longitudinal cross-sectional view that schematically illustrates the configuration in and around a combustion chamber 82 of a compression-ignition internal combustion engine 80 according to the fourth embodiment of the present disclosure. FIG. 9 is a transverse cross-sectional view obtained by cutting a passage wall portion 88 along an A-A line in FIG. 8. The internal combustion engine 80 according to the present embodiment is different from the internal combustion engine according to the second embodiment in the following points.

Specifically, the internal combustion engine 80 is equipped with a cylinder head 84 having a combustion chamber ceiling 84*a*. In the combustion chamber ceiling 84*a*, a flow guide passage 86 having the similar function to that of the flow guide passage 32 shown in FIG. 6 is formed. In other words, according to the present embodiment, a "passage forming member" forming the flow guide passage 86 is integrally formed with the cylinder head 84 (combustion chamber ceiling 84*a*).

Figure 9:
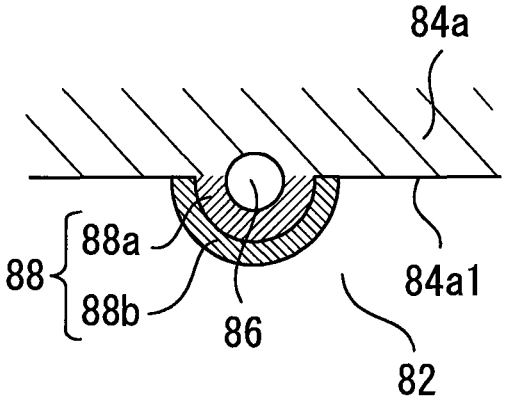
FIG. 9 is a transverse cross-sectional view obtained by cutting a passage wall portion along an A-A line in FIG. 8.

As shown in FIGS. 8 and 9, the combustion chamber ceiling 84*a* includes a passage wall portion 88 located radially outward of the flow guide passage 86. The passage wall portion 88 includes a first layer 88*a* and a second layer 88*b*. The first layer 88*a* is a base portion that is connected to the cylinder head 84 (combustion chamber ceiling 84*a*). That is to say, the first layer 88*a* is integrally formed with the cylinder head 84. In addition, the first layer 88*a* is formed so as to protrude to the side of the combustion chamber 12 from a base surface 84*a*1 of the combustion chamber ceiling 84*a*.

The second layer 88*b* is located radially outward of the first layer 88*a*. According to the example shown in FIG. 9, the second layer 88*b* is formed so as to cover the first layer 88*a* that protrudes from the base surface 84*a*1 of the combustion chamber ceiling 84*a*. In addition, according to this example, the second layer 88*b* is formed so as to also cover an end surface 88*a*1 of the first layer 88*a* located on the inlet side of the flow guide passage 86.

The materials of the first layer 88*a* and second layer 88*b* of the passage wall portion 88 according to the present embodiment are the same as those of the first layer 62*a* and second layer 62*b* according to the second embodiment, as an example. In addition, according to the present embodiment, the gap G is also formed between the outlet of the nozzle hole 22 and the inlet of the flow guide passage 86. The internal combustion engine 80 may include communication holes similar to the communication holes 74 (see FIG. 7) instead of this kind of gap G or in addition thereto.

4-2. Advantageous Effects

According to the internal combustion engine 80 including the passage wall portion 88 described so far, similar advantageous effects to those of the internal combustion engine according to the second embodiment including the duct(s) 60 can also be achieved. In addition, according to the example shown in FIG. 8, the second layer 88*b* is formed so as to also cover the end surface 88*a*1 of the first layer 88*a* located on the inlet side of the flow guide passage 86. As a result, an increase of the wall surface temperature of the flow guide passage 86 due to a heat input into the end surface 88*a*1 from a high temperature combustion gas can also be reduced.

It should be noted that, as the material of the second layer 88*b* of the duct 60 according to the present embodiment, silicon nitride (i.e., the example of the material that does not meet the above-described relationship with respect to the heat capacity) that is the same as the material of the second layer 36*b* according to the first embodiment may be used. In addition, in this example (i.e., in the example in which the effect of reducing the heating of a charged air suctioned into a duct through the gap G (see FIG. 6) or a communication hole is not required), the second layer 88*b* may alternatively be arranged radially inward of the first layer 88*a*, instead of the example shown in FIG. 8. This also applies to a fifth embodiment described below.

5. Fifth Embodiment

Then, a fifth embodiment according to the present disclosure will be described with reference to FIG. 10.

5-1. Difference from Fourth Embodiment

Figure 10:
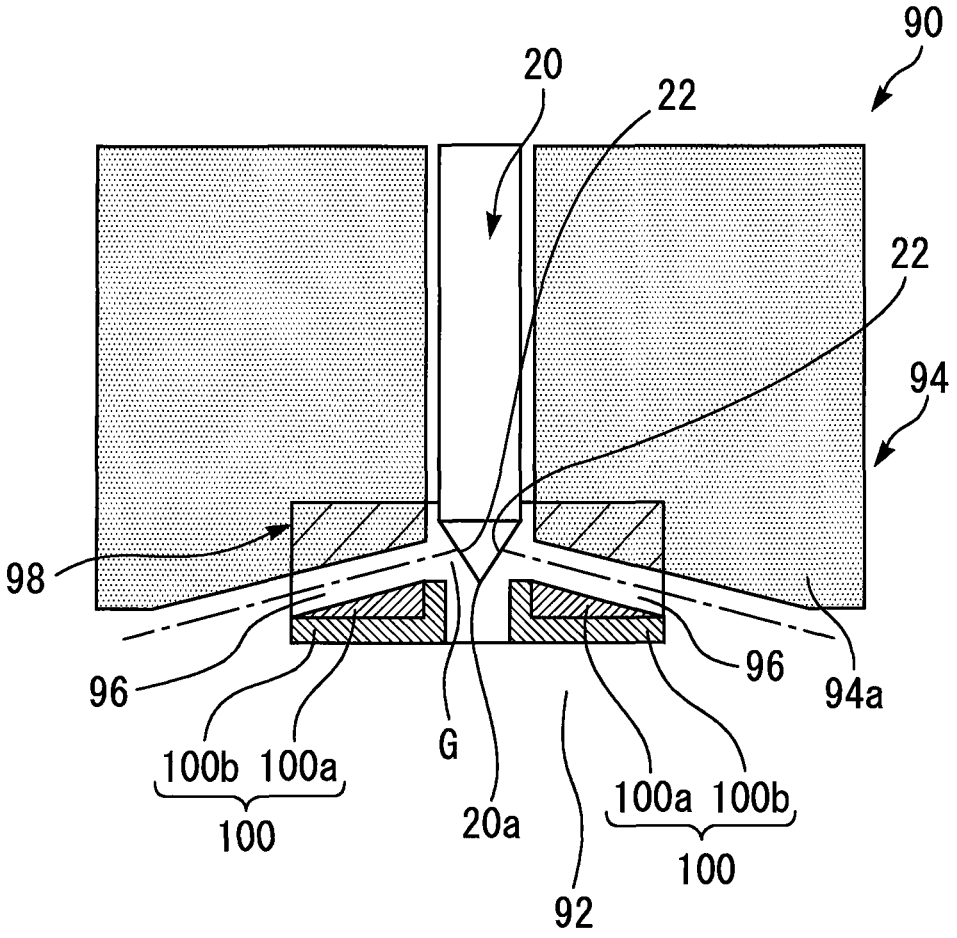
FIG. 10 is a longitudinal cross-sectional view that schematically illustrates the configuration in and around a combustion chamber of a compression-ignition internal combustion engine according to a fifth embodiment of the present disclosure.

FIG. 10 is a longitudinal cross-sectional view that schematically illustrates the configuration in and around a combustion chamber 92 of a compression-ignition internal combustion engine 90 according to the fifth embodiment of the present disclosure. The internal combustion engine 90 according to the present embodiment is different from the internal combustion engine 80 according to the fourth embodiment in the following points.

Specifically, the internal combustion engine 90 is equipped with a cylinder head 94 having a combustion chamber ceiling 94*a*. In the combustion chamber ceiling 94*a*, a passage forming member 98 that forms a flow guide passage 96 having the similar function to that of the flow guide passage 86 shown in FIG. 8 is fastened using a fastener (not shown). That is to say, according to the present embodiment, the passage forming member 98 is separately arranged from the cylinder head 94. The passage forming member 98 includes a passage wall portion 100 having a first layer 100*a* and a second layer 100*b*. The passage wall portion 100 is configured similarly to the passage wall portion 88 shown in FIG. 8. In addition, the first layer 100*a* is connected to the cylinder head 94 via a fastening surface located between the passage wall portion 100 and the cylinder head 94.

5-2. Advantageous Effects

As described so far, the passage wall portion 100 according to the present embodiment is formed in the passage forming member 98 separately arranged from the cylinder head 94. According to the internal combustion engine 90 having this kind of configuration, similar advantageous effects to those of the internal combustion engine according to the second embodiment having the duct 60 can also be achieved.

6. Sixth Embodiment

Then, a sixth embodiment according to the present disclosure and modification examples thereof will be described with reference to FIGS. 11 to 16.

6-1. Configuration In and Around Combustion Chamber

Figure 11:
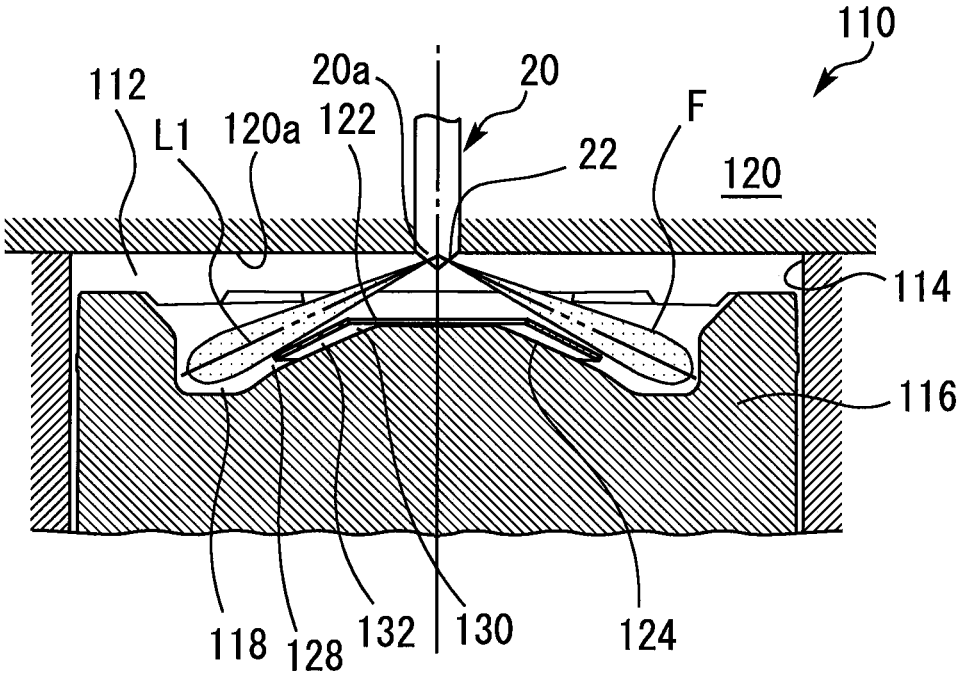
FIG. 11 is a longitudinal cross-sectional view that schematically illustrates the configuration in and around a combustion chamber of a compression-ignition internal combustion engine according to a sixth embodiment of the present disclosure.

FIG. 11 is a longitudinal cross-sectional view that schematically illustrates the configuration in and around a combustion chamber 112 of a compression-ignition internal combustion engine 110 according to the sixth embodiment of the present disclosure. The following explanation will be focused on the difference of the internal combustion engine 110 according to the present embodiment with respect to the internal combustion engine 10 according to the first embodiment.

As shown in FIG. 11, the internal combustion engine 110 is equipped with a piston 116 arranged in the interior of a cylinder 114. A cavity 118 is formed at a central part of the piston 116. This cavity 118 is also a part of the combustion chamber 112. A fuel injection nozzle 120 is arranged at the center of a combustion chamber ceiling 120*a* of a cylinder head 120.

The top portion of the piston 116 is provided with a flow guide plate 122. The flow guide plate 122 is fixed to the piston 116 at a predetermined distance (gap) from the cavity 118 formed at the top surface of the piston 116. In the following, a configuration of the piston 116 with the flow guide plate 122 fixed thereto will be described in more detail with reference to FIGS. 12 and 13.

Figure 12:
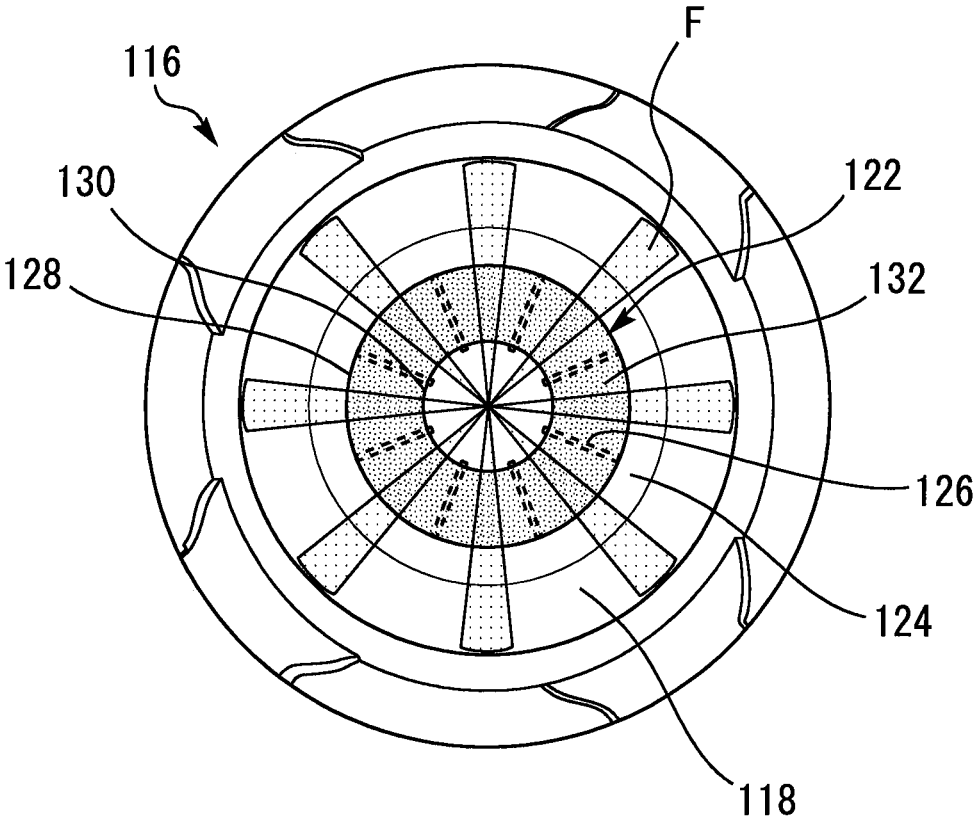
FIG. 12 is a view of a piston with a flow guide plate shown in FIG. 11 fixed thereto which is seen from the side of the top surface of the piston.
Figure 13:
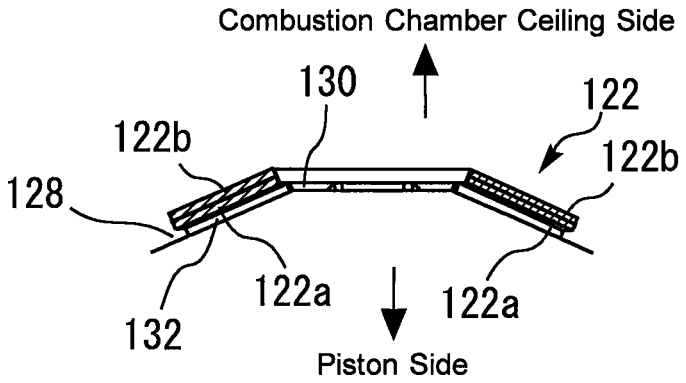
FIG. 13 is an enlarged view that illustrates the configuration around the flow guide plate shown in FIG. 11.

FIG. 12 is a view of the piston 116 with the flow guide plate 122 shown in FIG. 11 fixed thereto which is seen from the side of the top surface of the piston 116. FIG. 13 is an enlarged view that illustrates the configuration around the flow guide plate 112 shown in FIG. 11. As shown in these views, the flow guide plate 122 has an annular ring shape with a conical surface and covers a conical surface 124 included in surfaces of the cavity 118 that is downwardly inclined toward the outer peripheral side of the piston 116. The flow guide plate 122 extends at a constant distance from the conical surface 124 and is fixed to the piston 116 by support portions 126.

The support portions 126 are located between adjacent fuel sprays F and radially extend from an inner edge of the flow guide plate 122 having the annular ring shape toward an outer edge thereof. According to this kind of configuration, below each fuel spray F, a flow guide passage 132 having an inlet 128 located on the outer edge side (that is, the side of the wall of the bore of the cylinder 114) and an outlet 130 located on the inner edge side (that is, the side of the center of the bore of the cylinder 114) is formed in the gap between the flow guide plate 122 and the conical surface 124. The inlet 128 and the outlet 130 are exposed in the combustion chamber 112.

6-1-1. Flow Guide Plate (Passage Wall Portion) Having Double-Layered Structure The flow guide plate 122 is located on the side of the combustion chamber ceiling 120*a* with respect to the flow guide passage 132. According to the internal combustion engine 100 of the present embodiment, this flow guide plate 122 corresponds to an example of the "passage wall portion" according to another aspect of the present disclosure. As shown in FIG. 13, the flow guide plate (passage wall portion) 122 has a double-layered structure composed of a first layer 122*a* and a second layer 122*b*.

The first layer 122*a* corresponds to a base portion (base layer) connected to the piston 116 with the support portions 126 interposed therebetween. That is to say, the first layer 122*a* of the flow guide plate (passage wall portion) 122 is supported by the support portions 126.

The second layer 122*b* is located on the side of the combustion chamber ceiling 120*a* with respect to the first layer 122*a*. In more detail, as an example, the second layer 122*b* is formed so as to cover the whole first layer 122*a*. In addition, as an example, the materials of the first layer 122*a* and the second layer 122*b* are the same as those of the first layer 36*a* and the second layer 36*b* according to the first embodiment. That is to say, the toughness of the first layer 122*a* is higher than the toughness of the second layer 122*b*, and the thermal conductivity of the second layer 122*b* is lower than the thermal conductivity of the first layer 122*a*.

6-2. Advantageous Effects 6-2-1. Advantageous Effects of Using Flow Guide Plate (Passage Wall Portion)

Figure 14:
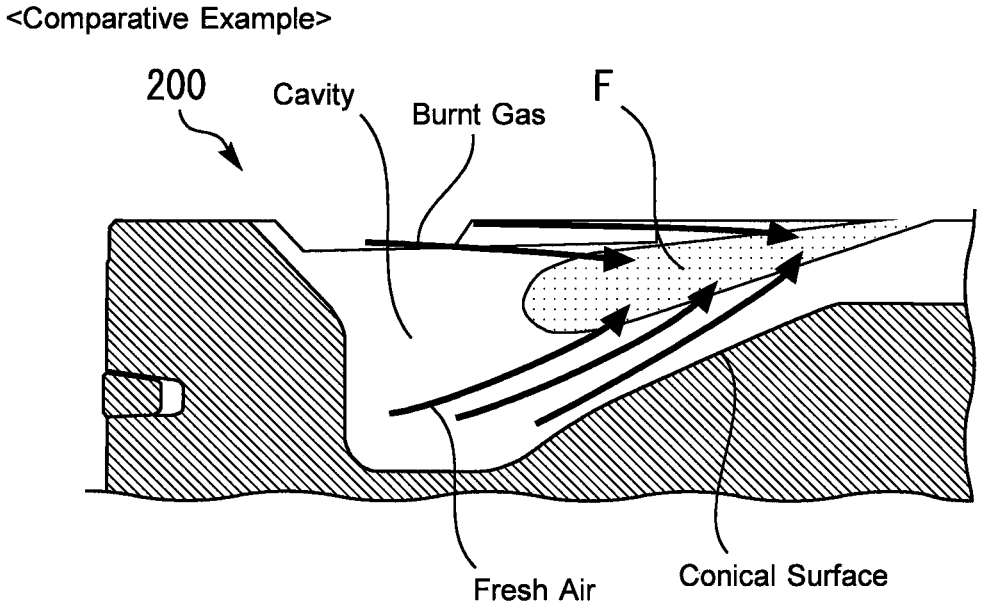
FIG. 14 is a schematic diagram for illustrating a flow of air in a combustion chamber of a compression-ignition internal combustion engine having a piston according to a comparative example without any flow guide plate.
Figure 15:
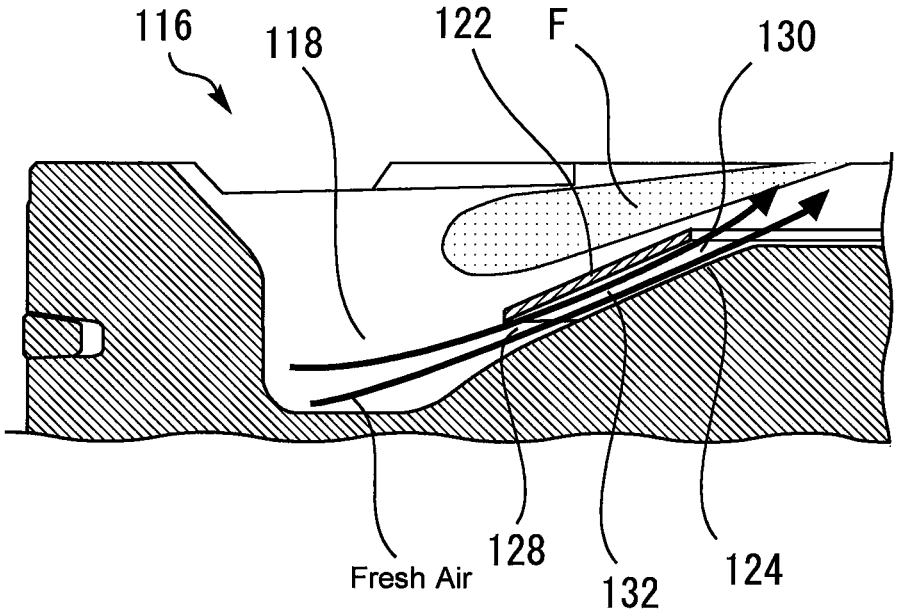
FIG. 15 is a schematic diagram for illustrating a flow of air in the combustion chamber of the compression-ignition internal combustion engine having the piston according to the sixth embodiment with the flow guide plate shown in FIG. 11 fixed thereto.

First, effects and advantages of the flow guide plate 122 will be described with reference to FIGS. 14 and 15. FIG. 14 is a schematic diagram for illustrating a flow of air in a combustion chamber of a compression-ignition internal combustion engine having a piston 200 according to a comparative example without any flow guide plate. FIG. 15 is a schematic diagram for illustrating a flow of air in the combustion chamber 112 of the compression-ignition internal combustion engine 110 having the piston 116 according to the sixth embodiment with the flow guide plate 122 shown in FIG. 11 fixed thereto.

First, in the comparative example, the flow of air in the combustion chamber of the internal combustion engine having the piston 200 without the flow guide plate 122 will be described. As shown in FIG. 14, in the internal combustion engine without the flow guide plate 122, in-cylinder gas (in more detail, fresh air in the combustion chamber) is taken in an upstream part of the fuel spray F while being mixed with a high-temperature burnt gas. As a result, there is a concern that, since the fuel spray F is mixed with the burnt gas at high temperature after ignition, the injected fuel may ignite too early. Because of this, an issue (such as, occurrence of smoke as a result of combustion of rich fuel or a decrease in thermal efficiency as a result of extension of the afterburning period) may occur.

In contrast to the above, in order to address the issue described above, the internal combustion engine 110 according to the present embodiment includes the piston 116 provided with the flow guide plate 122. As shown in FIG. 15, the flow guide passage 132 is formed in the gap between the conical surface 124 of the piston 116 and the flow guide plate 122. The fuel spray F injected from the fuel injection nozzle 20 is dispersed into the cavity 118 along an upper surface of the flow guide plate 122 (i.e., the surface located on the combustion chamber ceiling 120*a*). In association with this, fresh air in the combustion chamber 112 is introduced into the flow guide passage 132 through the inlet 128. The flow guide passage 132 is isolated from the fuel spray F by the flow guide plate 122. Because of this, the fresh air introduced in the flow guide passage 132 through the inlet 128 exits the outlet 130 while being not mixed with much burnt gas at high temperature. As a result, the fresh air maintained at low temperature is taken in the upstream part of the fuel spray F, and it thus takes a certain time for the injected fuel to ignite. Therefore, combustion of rich fuel can be prevented, and occurrence of smoke or a decrease in thermal efficiency as a result of extension of the afterburning period can thus be prevented.

Furthermore, since the internal combustion engine 110 according to the present embodiment includes the flow guide passage 132 located on the lower side (that is, the side of the piston 116) of the fuel sprays F, a low temperature fresh air exiting the outlet 130 can be efficiently taken in the upstream part of the fuel sprays F.

6-2-2. Issue on Installation of Flow Guide Plate (Passage Wall Portion)

A flow guide plate as in the flow guide plate 122 is exposed in a combustion chamber. That is to say, similarly to the example of the duct 30 according to the first embodiment, the flow guide plate 122 is arranged at a location in which the temperature thereof is easy to become higher due to the fact that the flow guide plate 122 is exposed to a high-temperature combustion gas. If the temperature of the wall surface itself of a flow guide passage (i.e., the wall surface itself of the flow guide plate located on the side of a piston) becomes higher due to the heat received from combustion gas, fresh air that passes through the flow guide plate is heated by the heat received from the flow guide plate. As a result, ignition delay is shortened (that is, the effect of retarding the self-ignition timing decreases), and thus, the combustion may be started before the fuel spray is sufficiently mixed with the charged air. Because of this, there is a concern that it may become difficult to properly reduce the occurrence of smoke.

In addition, in an example of the flow guide plate (passage wall portion), similarly to the example of the duct, it is required for countermeasures regarding reduction of temperature increase of the flow guide plate to be made such that, even if a weight or load is repeatedly applied to the flow guide plate, the shape of the flow guide plate can be more surely maintained over a long time.

6-2-3. Application of Flow Guide Plate (Passage Wall Portion) Having Double-Layered Structure In view of the issue described above, according to the flow guide plate (passage wall portion) 122 of the present embodiment, the first layer 122*a* is configured as a base portion that is connected to the piston 116 with the support portions 126 interposed therebetween. Also, the materials of the first layer 122*a* and second layer 122*b* are selected such that the toughness of the first layer 122*a* becomes higher than the toughness of the second layer 122*b*. As a result, even if the weight or load described above is repeatedly applied to the flow guide plate 122, the shape of the flow guide plate 122 can be more surely maintained over a long time.

Moreover, the materials of those layers 122*a* and 122*b* of the flow guide plate 122 are selected such that the thermal conductivity of the second layer 122*b* becomes lower than the thermal conductivity of the first layer 122*a*. As a result, the heat transferred to the wall of the flow guide plate 122 located on the side of the combustion chamber ceiling 120*a* (i.e., the outer wall of the second layer 122*b*) from a high temperature combustion gas around the flow guide plate 122 can be prevented from being transferred to the wall of the flow guide plate 122 located on the side of the piston 116 (i.e., the wall surface of the flow guide passage 132). Because of this, when the in-cylinder gas (fresh air) passes through the flow guide passage 132 located on the side of the piston 116 of the flow guide plate 122, an increaser of temperature of the fresh air can be reduced. As a result, a decrease of the effect of retarding the self-ignition timing can be reduced.

As described so far, according to the internal combustion engine 110 of the present embodiment, the reliability of maintaining the shape of the flow guide plate 122 (passage wall portion) can be favorably enhanced, and an increase of the wall surface temperature of the flow guide passage 132 can be favorably reduced.

Furthermore, as the material of the second layer 122*b*, a material that is smaller in heat capacity per unit volume than that of the first layer 122*a* may alternatively be selected similarly to the second layer 62*b* according to the second embodiment. As a result, the temperature of the second layer 122*b* can be prevented from always being high, and thus, an increase of the wall surface temperature of the flow guide passage 132 can be reduced more effectively.

6-3. Modification Examples Concerning Sixth Embodiment

Figure 16:
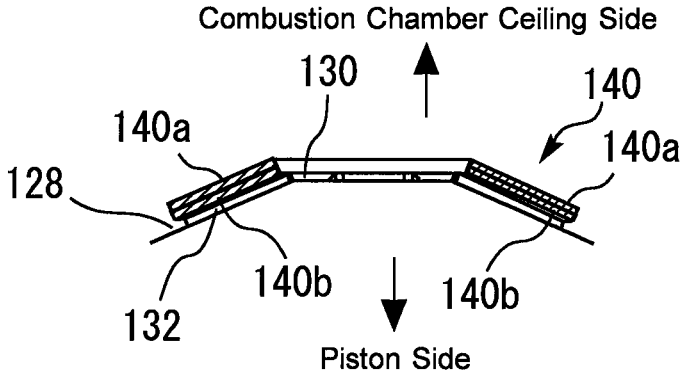
FIG. 16 is a diagram for describing another example of the configuration of the first layer and second layer of the flow guide plate (passage wall portion).

6-3-1. Another Example of Double-Layered Structure for Passage Wall Portion FIG. 16 is a diagram for describing another example of the configuration of the first layer and second layer of the flow guide plate (passage wall portion). According to the example shown in FIG. 16, a flow guide plate 140 (passage wall portion) includes a first layer 140*a* that is a base portion and a second layer 140*b* located on the side of the piston 116 with respect to the first layer 140*a*. The double-layered structure for the passage wall portion may be changed as just described.

6-3-2. Another Example of Configuration of Passage Wall Portion

The flow guide passage 132 according to the sixth embodiment described above is formed between the flow guide plate 122 and the cavity 118. However, a "flow guide passage" formed in a top portion of a piston according to another aspect of the present disclosure may be a through hole that is directly formed at a wall portion having a cavity of the piston, instead of the configuration described above. In this example, a part of a wall portion of the cavity having a double-bottom shape that is located on the side of the combustion chamber ceiling corresponds to an example of the "passage wall portion" according to another aspect of the present disclosure.

7. Other Embodiments

7-1. Other Examples of Selection of Material of Second Layer

In another example of the "second layer" that satisfies the above-described relationships regarding not only the toughness and the thermal conductivity but also the heat capacity per unit volume, the following may be used instead of zirconia ($ZrO_2$) described above. That is to say, where an aluminum alloy is used as a material of the "first layer", the second layer may be an anodized aluminum film formed by performing anodizing treatment on the surface of the first layer. According to the anodized aluminum film, a porous structure having pores that are formed in the process of the anodizing treatment is achieved, and thus, the second layer serves as a heat-shielding film that is lower in thermal conductivity and smaller in heat capacity per unit volume than the first layer.

Moreover, in still another example of the "second layer", a ceramics-sprayed film obtained by performing thermal spraying of another ceramics (such as, zircon ($ZrSiO_4$), silica ($SiO_2$), silicon nitride ($Si_3N_4$), yttria ($Y_2O_3$) or titanium oxide ($TiO_2$)) may be used instead of zirconia ($ZrO_2$) described above. These sprayed-films have internal air bubbles that are formed in the process of the thermal spraying, and thus serve as heat-shielding films having lower heat capacities per unit volume than metal (such as, aluminum or iron used as the material of the first layer), similarly to the anodized aluminum film.

Furthermore, in yet another example of the "second layer", a heat-insulating film (heat-shielding film) having the following structure may be used, as long as the whole second layer satisfies the above-described relationships regarding the toughness, the thermal conductivity and the heat capacity per unit volume. That is to say, this heat-shielding film includes a first heat insulator and a second heat insulator. The first heat insulator has a thermal conductivity lower than that of the base material (i.e., first layer) and also has a heat capacity per unit volume smaller than that of the base material. The second heat insulator has a thermal conductivity lower than or equal to the base material. In addition, the first heat insulator has a thermal conductivity lower than that of the second heat insulator, and the first heat insulator has a heat capacity per unit volume smaller than that of the second heat insulator. On that basis, specific examples of the first heat insulator include hollow ceramic beads, hollow glass beads, heat-insulating material having a microporous structure, silica aerogel, or any desired combination thereof. Also, specific examples of the second heat insulator include zirconia, silicon, titanium, zirconium, other ceramics, ceramic fibers, or any desired combination thereof. It should be noted that the details of heat-shielding films having these kinds of configurations are described in JP 5629463 B.

7-2. Another Example of Compression-Ignition Internal Combustion Engine

According to the first to sixth embodiments described above, diesel engines are used as an example of compression-ignition internal combustion engines. However, in another example, a compression-ignition internal combustion engine according to the present disclosure may be a premixed compression-ignition internal combustion engine that uses gasoline as its fuel, instead of the diesel engine.

7-3. Examples of Multi-Layered Structure Other Than Double-Layered

In other examples, a passage wall portion of a flow guide passage according to the present disclosure may not always have a double-layered structure as in the first to sixth embodiments described above and may have a multi-layered structure of triple or more multiple layers, as long as it includes a "first layer" and a "second layer" according to the present disclosure. That is to say, for example, the passage wall portion may have a triple-layered structure including a hollow layer located between the "first layer" and the "second layer". In addition, for example, in order to increase the toughness of the passage wall portion or decrease the amount of heat transfer, the passage wall portion may has a third layer made of a different material located between the "first layer" and the "second layer", or located on a side of the "first layer" opposite to the "second layer", or located on a side of the "second layer" opposite to the "first layer". Examples of these kinds of the third layers include a layer having a material for strengthening the bonding between the first layer and the second layer or a material for strengthening the coating of the second layer on the first layer.

7-4. Another Example of Passage Wall Portion

"Passage wall portions" according to the present disclosure and having a first layer connected to a cylinder head also include a passage wall portion without any of the gap G (see FIG. 2) and the communication hole 74 (see FIG. 7) contrary to the first to fifth embodiments described above. That is to say, by the use of this kind of passage wall portion, the passage wall portion may alternatively be configured so as to include a "first layer" and a "second layer" in order to reduce an increase of the wall surface temperature of a flow guide passage.

The embodiments and modification examples described above may be combined in other ways than those explicitly described above as required and may be modified in various ways without departing from the scope of the present disclosure.

What is claimed is:

1. A compression-ignition internal combustion engine, comprising:

a fuel injection nozzle including a tip end portion exposed in a combustion chamber and a nozzle hole formed at the tip end portion; and a passage forming member forming a flow guide passage through which fuel injected from the nozzle hole passes, wherein the passage forming member includes a passage wall portion located radially outward of the flow guide passage, wherein the passage wall portion includes a first layer that is a base portion connected to a cylinder head, and a second layer located radially outward or radially inward of the first layer, wherein the first layer is one of a radially innermost layer or a radially outermost layer of the passage wall portion and the second layer is the other of the radially innermost layer or the radially outermost layer of the passage wall portion, wherein a toughness of the first layer is higher than a toughness of the second layer, and wherein a thermal conductivity of the second layer is lower than a thermal conductivity of the first layer.

2. The compression-ignition internal combustion engine according to claim 1, wherein the second layer is located radially outward of the first layer.

3. The compression-ignition internal combustion engine according to claim 1, wherein a gap is formed between an outlet of the nozzle hole and an inlet of the flow guide passage, and wherein a heat capacity per unit volume of the second layer is smaller than a heat capacity per unit volume of the first layer.

4. The compression-ignition internal combustion engine according to claim 1, wherein one or more communication holes that cause the flow guide passage to communicate with the combustion chamber are formed in the passage wall portion, and wherein a heat capacity per unit volume of the second layer is smaller than a heat capacity per unit volume of the first layer.

5. The compression-ignition internal combustion engine according to claim 1, wherein the passage forming member further includes a support portion interposed between the first layer and the cylinder head, and wherein the passage wall portion is composed of the first layer and the second layer and is formed into a cylindrical shape.

6. The compression-ignition internal combustion engine according to claim 1, wherein the passage forming member is integrally formed with the cylinder head.

7. The compression-ignition internal combustion engine according to claim 1, wherein the passage forming member is fastened to a combustion chamber ceiling of the cylinder head.

* * * * *